US008077900B2

(12) United States Patent
Minamio et al.

(10) Patent No.: US 8,077,900 B2
(45) Date of Patent: Dec. 13, 2011

(54) MICROPHONE AND METHOD FOR FABRICATING THE SAME

(75) Inventors: Masanori Minamio, Osaka (JP); Yoshihiro Tomita, Osaka (JP); Koji Nomura, Nara (JP)

(73) Assignee: Panasonic Corporation, Osaka (JP)

( * ) Notice: Subject to any disclaimer, the term of this patent is extended or adjusted under 35 U.S.C. 154(b) by 479 days.

(21) Appl. No.: 12/396,010

(22) Filed: Mar. 2, 2009

(65) Prior Publication Data

US 2009/0238394 A1 Sep. 24, 2009

(30) Foreign Application Priority Data

Mar. 18, 2008 (JP) ..... 2008-070018
Dec. 25, 2008 (JP) ..... 2008-329192

(51) Int. Cl.
*H04R 11/04* (2006.01)

(52) U.S. Cl. ..... 381/355; 381/361; 29/594; 257/419
(58) Field of Classification Search ..... 381/355, 381/361; 29/594; 257/419
See application file for complete search history.

(56) References Cited

U.S. PATENT DOCUMENTS

| | | | | |
|---|---|---|---|---|
| 7,579,678 | B2 * | 8/2009 | Suzuki et al. | 257/678 |
| 2002/0148289 | A1 | 10/2002 | Isogai et al. | |
| 2003/0133588 | A1 | 7/2003 | Pederson | |
| 2005/0194685 | A1 | 9/2005 | Weiblen et al. | |
| 2006/0185437 | A1 | 8/2006 | Sato et al. | |
| 2006/0210106 | A1 | 9/2006 | Pederson | |
| 2007/0144261 | A1 | 6/2007 | Okuda et al. | |
| 2007/0157731 | A1 | 7/2007 | Okuda et al. | |
| 2008/0173096 | A1 | 7/2008 | Sato et al. | |

FOREIGN PATENT DOCUMENTS

| | | |
|---|---|---|
| JP | 09-092670 | 4/1997 |

* cited by examiner

*Primary Examiner* — Tu-Tu Ho
(74) *Attorney, Agent, or Firm* — McDermott Will & Emery LLP

(57) ABSTRACT

A microphone includes: a substrate including a tone hole and having a top surface on which a substrate electrode is provided; a converter provided on the top surface of the substrate and including a main body having a back space, a diaphragm provided at the bottom of the back space of the main body, and a converter electrode provided on a region of a bottom surface of the main body facing the substrate electrode; and a bump connecting the substrate electrode and the converter electrode to each other. The diaphragm vibrates in response to sound entering from the tone hole. The converter converts sound into a signal.

14 Claims, 4 Drawing Sheets

MICROPHONE AND METHOD FOR FABRICATING THE SAME

CROSS-REFERENCE TO RELATED APPLICATION

This application claims priority from Japanese Patent Application JP2008-070018 filed on Mar. 18, 2008 and Japanese Patent Application JP2008-329192 filed on Dec. 25, 2008, the disclosure of which application is hereby incorporated by reference into this application in its entirety for all purposes.

BACKGROUND

Techniques proposed in this disclosure relate to microphones and methods for fabricating the microphones.

For portable equipment such as cell phones, for example, further reduction in size and weight has been demanded. To meet such demands, microphones incorporated therein have been designed to be smaller and lighter.

Specifically, reduction in size and weight has been tried to be achieved by forming a microphone into a substrate module in which a converter for converting sound into an electrical signal is mounted on a substrate having a tone hole and in which a substrate electrode on the substrate and a vibrator electrode on the converter are connected to each other by bonding wires. Though not to be intended for microphones, a similar conventional technique is disclosed in Japanese Laid-Open Patent Publication No. 9-92670, which is directed to size reduction for package.

SUMMARY

The conventional technique, however, has a drawback in which the resultant device is not sufficiently small. Specifically, with the technique, a converter is mounted on a substrate, and then a substrate electrode on the substrate and a vibrator electrode on the converter are connected to each other by bonding wires as described above. The connection by bonding wires inevitably requires a large space for drawing these bonding wires, resulting in insufficient reduction in size of package. Therefore, a microphone to which the conventional technique is applied cannot be sufficiently small.

An example microphone of this disclosure Can be downsized as described below.

An example microphone of this disclosure includes: a substrate including a tone hole and having a top surface on which a substrate electrode is provided; a converter for converting sound pressure into an electrical signal, the converter being mounted on the top surface of the substrate; a shield cap; and a bump. The converter includes a main body having a back space, a diaphragm for receiving the sound pressure, the diaphragm being provided at the bottom of the back space of the main body, and a converter electrode provided on a region of a bottom surface of the main body facing the substrate electrode. The shield cap is in contact with top and side surfaces of the main body and covers the back space at a top of the back space. The bump connects the substrate electrode and the converter electrode to each other.

This structure makes the thickness of the space in front of the diaphragm smaller than that in a conventional microphone, without changing the diameter of the tone hole, thus reducing the size of the microphone without deteriorating the sound collecting performance of the microphone. Accordingly, the use of the microphone described above may implement small and lightweight portable equipment.

The main body of the converter may be made of silicon. Then, a microphone can be easily fabricated by using semiconductor processes.

The diaphragm may be made of silicon, and the main body and the diaphragm may be continuous.

The back space may penetrate the main body and expand upward from the diaphragm.

The microphone may further include a resin member covering a portion of the top surface of the substrate and at least a portion of an external surface of the shield cap. The presence of the resin member covering the shield cap enhances the impact resistance of the microphone so that the use of the example microphone can increase the impact resistance of portable equipment.

The resin member may cover a side surface of the shield cap.

The microphone may further include an amplifier for amplifying a signal generated by the converter.

The substrate may include a mounting terminal provided on a bottom surface of the substrate.

The back space preferably has a volume larger than that of a space between a bottom surface of the diaphragm and the tone hole. In this case, the diaphragm easily vibrates in a wide frequency band while assuring sufficient sound collecting performance.

An example method for fabricating a microphone includes the steps of: (a) preparing a converter including a main body having a back space, a diaphragm provided at the bottom of the back space, and a converter electrode provided on a bottom surface of the main body; (b) mounting the converter on a substrate including a tone hole and a having a top surface on which a substrate electrode is provided at a position corresponding to the converter electrode, and connecting the converter electrode and the substrate electrode to each other; and (c) providing, on the substrate, a shield cap which is in contact with top and side surfaces of the main body and covers the back space at a top of the back space, after the step (b).

This method enables implementation of a small microphone.

In step (b), the converter electrode and the substrate electrode may be connected to each other by thermosonic bonding.

The method may further includes the step of (d) encapsulating, with resin, a portion of the top surface of the substrate and at least a portion of an external surface of the shield cap, after step (c). Then, a microphone with a higher impact resistance can be implemented.

Step (a) may include the step of (a1) selectively performing wet etching on a center portion of a silicon plate, thereby forming the back space in the shape of an inverted pyramid.

In step (a1), the wet etching may be stopped before the back space penetrates the main body, thereby making the diaphragm and the main body continuous.

As described above, in the example microphone, the space in front of the diaphragm is thinner than that in a conventional microphone without a change in diameter of the tone hole. Therefore, it is possible to reduce the size of the microphone without deteriorating the sound collecting performance of the microphone. Accordingly, the use of the microphone described above may implement small and lightweight portable equipment.

DETAILED DESCRIPTION OF THE INVENTION

Hereinafter, an embodiment of the present invention will be described with reference to the accompanying drawings.

Figure 1:
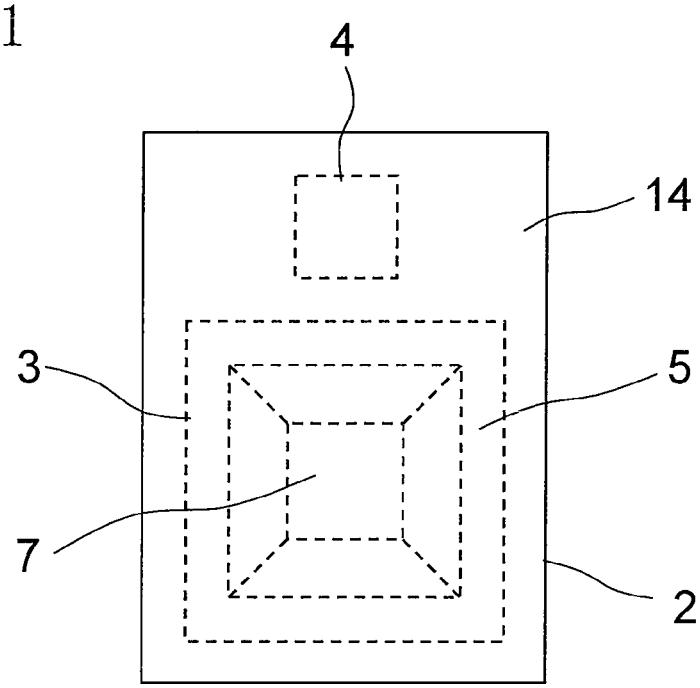
FIG. 1 is a plan view illustrating the top of a microphone according to an embodiment of the present invention.
Figure 2:
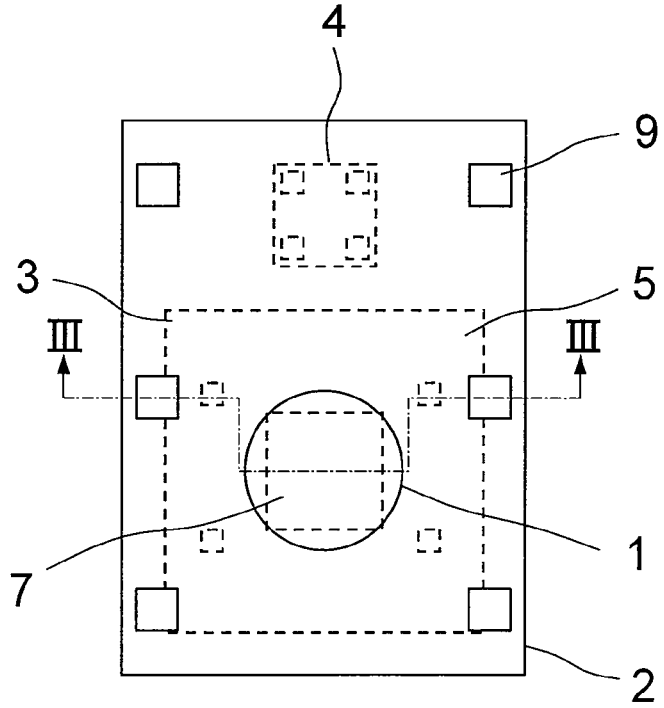
FIG. 2 is a plan view illustrating the bottom of the microphone.
Figure 3:
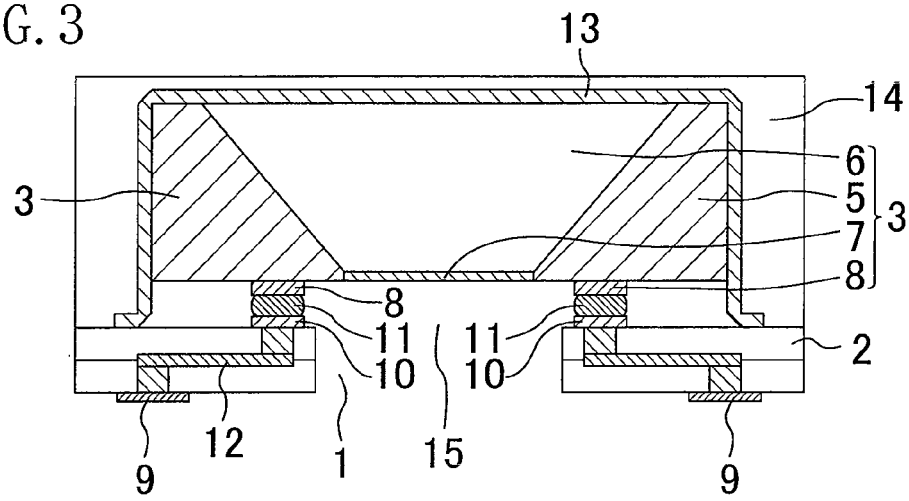
FIG. 3 is a cross-sectional view illustrating the microphone, taken along the line III-III in FIG. 2.

FIG. 1 is a top plan view illustrating the top of a microphone according to an embodiment of the present invention. FIG. 2 is a plan view illustrating the bottom of the microphone. FIG. 3 is a cross-sectional view illustrating the microphone, taken along the line III-III in FIG. 2.

As illustrated in FIGS. 1 to 3, the microphone of this embodiment includes; a rectangular substrate 2 having a circular tone hole 1; a converter 3 mounted on the substrate 2; and an amplifier 4 encapsulated by a resin member 14 together with the substrate 2 and the converter 3.

The converter 3 includes a main body 5, a diaphragm 7, and a converter electrode 8. The main body 5 is made of, for example, silicon and is square when viewed from above the substrate 2. The diaphragm 7 is connected to the main body 5. The converter electrode 8 is provided on the bottom surface of the main body 5. The main body 5 has a back space in the shape of an inverted pyramid expanding upward from the position at which the diaphragm 7 is located.

Though not shown, a piezoelectric element is attached to the diaphragm 7. The piezoelectric element is configured to convert sound (sound pressure) into an electrical signal by means of vibration of the diaphragm 7 caused by sound entering from the tone hole 1. The obtained electrical signal is amplified by the amplifier 4 and output from a mounting terminal 9 on the substrate 2 to a control circuit of electric equipment such as a cell phone. The piezoelectric element may be provided on any of the top and bottom surfaces of the diaphragm 7. The piezoelectric element may be replaced by an electret. Alternatively, a capacitor, one of which electrode is the diaphragm 7, may be provided. In this case, the capacitor converts sound pressure into an electrical signal.

A substrate electrode 10 is formed on the top surface of the substrate 2 at the position facing the converter electrode 8. This substrate electrode 10 and the converter electrode 8 are electrically connected to each other via a bump 11. Connections between the substrate electrode 10 and the mounting terminal 9 and between the substrate electrode 10 and the amplifier 4 may be established using a pattern 12 formed in the substrate 2, as necessary. Accordingly, the electrical signal converted by the diaphragm 7 from sound entering from the tone hole 1 is amplified by the amplifier 4, and then is output from the mounting terminal 9 on the substrate 2 to a control circuit of electric equipment such as a cell phone.

The microphone of this embodiment also includes a shield cap 13 in close contact with the top and side surfaces of the converter 3 (the main body 5) to cover the top of the back space 6 formed in the converter 3. Specifically, as illustrated in FIG. 3, the top and side surfaces of the main body 5 of the converter 3 are covered with the metal shield cap 13, thus suppressing entering of external noise components from the top surface of the main body 5. Covering the top surface of the main body 5 of the converter 3 with the shield cap 13 fixes the size of the back space 6, thus stabilizing acoustic properties. A direct contact of the shield cap 13 with the main body 5 stabilizes the potential of the main body 5 through the shield cap 13, thus achieving a microphone having a high resistance to disturbance noise. Unlike a conventional structure in which a substrate with a microphone is covered with a shield cap, the shield cap 13 is in direct contact with the main body 5 in this embodiment so that the back space 6 is reduced and the whole module can be thus downsized. The "side surface of the main body 5" herein means the external side surface of the main body 5, and does not mean the surface facing the back space 6 without being specified.

After formation of the shield cap 13, the top surface of the substrate 2 and the top and side surfaces of the main body 5, together with an amplifier 4, are encapsulated with a resin member 14 so as both to unite the substrate 2 and the converter 3, and to protect the converter 3 and the amplifier 4.

With the substrate 2 and the converter 3 united in such a way as described above, the back space 6 formed in the main body 5 of the converter 3 has a volume larger than that of a front space 15 formed between the bottom surface of the diaphragm 7 in contact with the back space 6 and the tone hole 1 at the bottom surface of the substrate 2.

This is because as the back space 6 becomes larger, the diaphragm 7 vibrates more easily in a wider frequency band. According to the idea of a Helmholtz resonator, when sound enters from the front space 15 connected to the back space 6 having a volume Va with the diaphragm 7 interposed therebetween, the piston effect occurs to compress and expand the air inside the space, thus causing vibration of the diaphragm 7.

Figure 7:
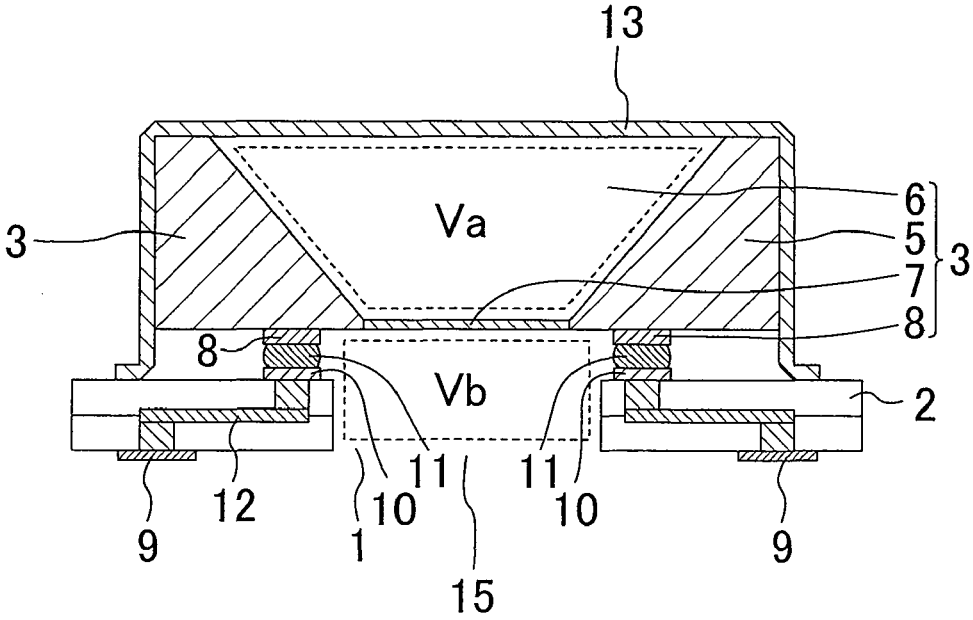
FIG. 7 is a cross-sectional view illustrating the microphone of the embodiment.

With reference to FIG. 7, the relationship of Va (i.e., the volume of the back space 6)>Vb (i.e., the volume of the front space 15 in front of the diaphragm 7) is established. Since the front space 15 is formed mainly in order to allow sound entering, the front space 15 preferably has a minimum vertical dimension to reduce the spatial volume while having a sufficient two-dimensional area and the back space 6 preferably has a maximum spatial volume so that the diaphragm 7 can easily vibrate in a wide frequency band. For a conventional microphone, the relationship of Va (i.e., the volume of the back space)<Vb (i.e., the volume of the front space 15 in front of the diaphragm) is established.

In the microphone of this embodiment, the substrate 2 having the tone hole 1 is connected to the converter 3 including the main body 5 and the diaphragm 7 with the bump 11 as described above, so that the volume of the front space 15 in front of the diaphragm 7 can be reduced without a decrease in size of the tone hole 1, as compared to the case of using wires. Accordingly, it may be possible to reduce the size of the microphone without deteriorating the sound collecting performance of the microphone.

In addition, covering of the side and top surfaces of the shield cap 13 with the resin member 14 suppresses damage not only from the side of the converter 3 but also from above the converter 3. The microphone of this embodiment has a high impact resistance while achieving reduction in size and thickness, and thus is preferably used especially for portable communication equipment, such as cell phones, having a high possibility of being dropped or the like.

The resin member 14 may cover the entire side surface of the shield cap 13. Even when the resin member 14 partially covers the top and side surfaces of the shield cap 13, the microphone still has a higher impact resistance than that in the case of providing no resin member 14.

Figure 4:
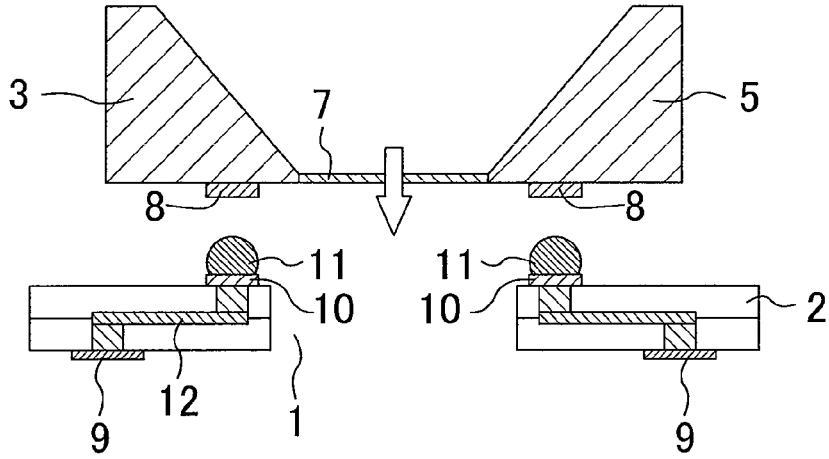
FIG. 4 is a cross-sectional view showing a method for fabricating a microphone according to the embodiment.
Figure 5:
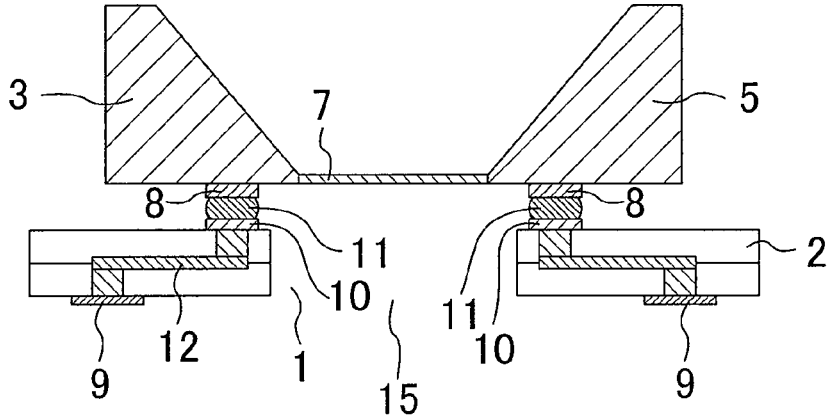
FIG. 5 is a cross-sectional view showing the method for fabricating a microphone according to the embodiment.
Figure 6:
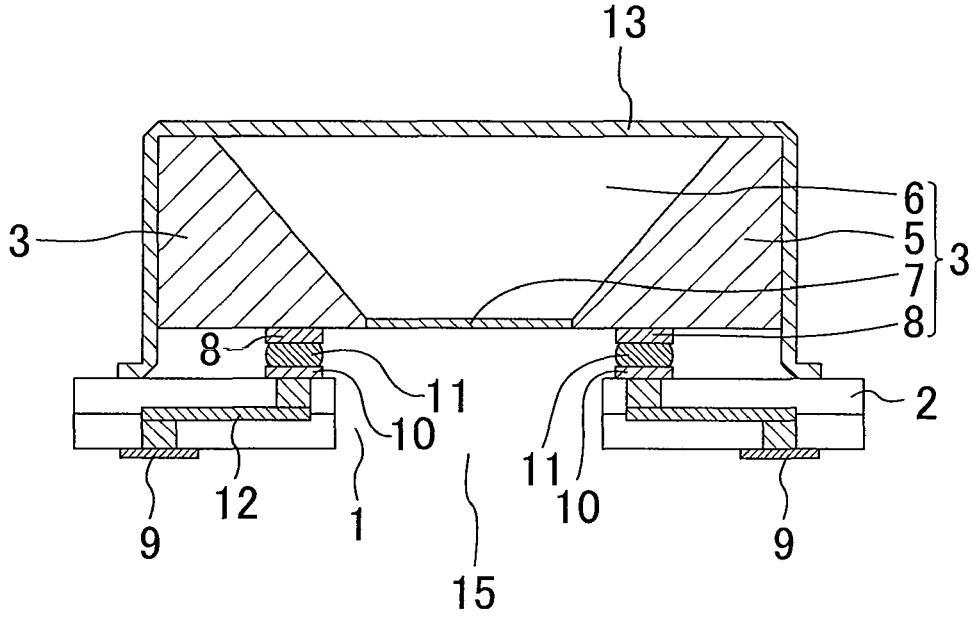
FIG. 6 is a cross-sectional view showing the method for fabricating a microphone according to the embodiment.

FIGS. 4, 5, and 6 are cross-sectional views showing a method for fabricating a microphone according to this embodiment. As shown in FIG. 4, a silicon main body 5 is first wet etched from above, thereby forming a tone hole 1 through the main body 5 at the center thereof. Subsequently, a diaphragm 7 is attached to a portion of the bottom of the main body 5 surrounding the tone hole 1. Then, as shown in FIG. 5, a substrate electrode 10 on the top surface of the substrate 2 and a converter electrode 8 on the main body 5 are connected to each other by thermosonic bonding with the main body 5 of the converter 3 mounted on the top surface of the substrate 2. Thereafter, as shown in FIG. 6, the substrate electrode 10 and the converter electrode 8 are connected to each other, the main body 5 is covered with the shield cap 13, and these components are encapsulated with a resin member 14. In this step, the resin member also encapsulates an amplifier. The shield cap 13 is provided to be in close contact with the top and side surfaces of the converter 3 (the main body 5) and to cover the top of the back space 6. With the foregoing method of this embodiment, a microphone can be fabricated using semiconductor processes.

In this embodiment, the diaphragm 7 and the converter 3 are distinct parts. Alternatively, the diaphragm 7 and the converter 3 may be formed out of silicon to be continuous. More specifically, the back space 6 of the converter 3 is formed through the silicon main body 5 by performing wet etching on the main body 5 from above in the foregoing method. However, this etching may be stopped halfway so as to form a converter 3 in which the diaphragm 7 is continuous to the main body 5.

The materials for, and the positions of, components of the microphone of this embodiment may be changed as necessary. For example, the two-dimensional shape of the main body 5 is not necessarily a square and may be a polygon such as a rectangle or a circle.

The substrate electrode 10 and the converter electrode 8 may be connected to each other with a process except for thermosonic bonding.

-Modified Example of Microphone-

Figure 8:
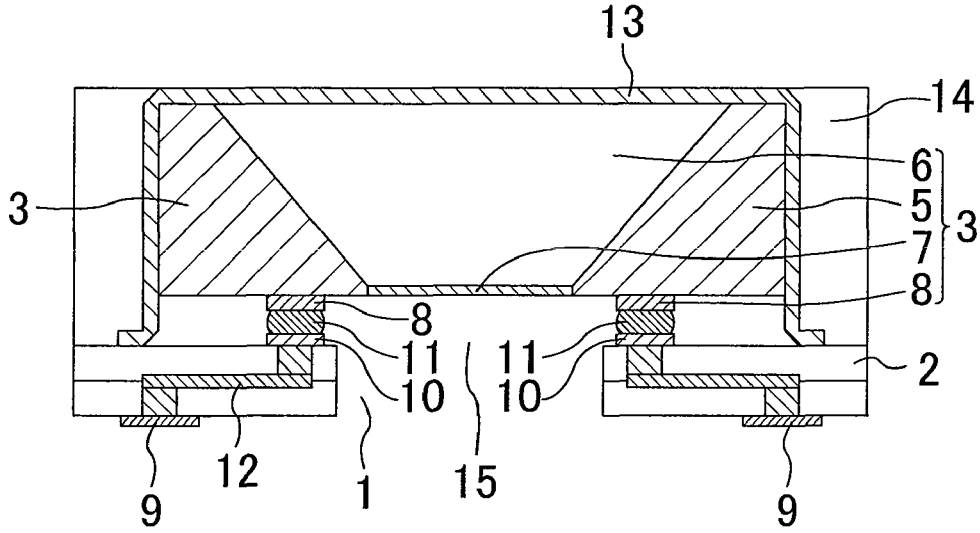
FIG. 8 is a cross-sectional view illustrating a modified example of the microphone of the embodiment.

FIG. 8 is a cross-sectional view illustrating a modified example of the microphone of this embodiment.

As shown in FIG. 8, the resin member 14 does not cover the top surface of the shield cap 13 and covers only the side surface of the shield cap 13 in the microphone of FIG. 3. Even in this case, the resistance to impact from the side of the converter 3 is enhanced because of the presence of the resin member 14, so that the microphone is preferably applicable to communication equipment such as cell phones. In addition, since the resin member 14 is not provided on the top surface of the shield cap 13 in the microphone of this modified example, this microphone can be thinner than the microphone of FIG. 3 accordingly.

The resin member 14 may cover the entire side surface of the shield cap 13. However, the resin member 14 may partially cover the side surface of the shield cap 13. Even in this case, the impact resistance of the microphone can be enhanced.

The resin member 14 may be provided only on the top surface, not on the side surface, of the shield cap 13. Covering at least a portion of the external surface (i.e., the side and top surfaces) of the shield cap 13 with the resin member 14 can enhance the impact resistance.

The example microphones described above are useful for reduction in size and weight of portable equipment, such as cell phones, for outputting and inputting sound, for example.

The foregoing description illustrates and describes the present disclosure. Additionally, the disclosure shows and describes only the preferred embodiment of the disclosure, but, as mentioned above, it is to be understood that it is capable of changes or modifications within the scope of the concept as expressed herein, commensurate with the above teachings and/or skill or knowledge of the relevant art. The described hereinabove are further intended to explain best modes known of practicing the invention and to enable others skilled in the art to utilize the disclosure in such, or other embodiments and with the various modifications required by the particular applications or uses disclosed herein. Accordingly, the description is not intended to limit the invention to the form disclosed herein. Also it is intended that the appended claims be construed to include alternative embodiments.

What is claimed is:

1. A microphone, comprising:

a substrate including a tone hole and having a top surface on which a substrate electrode is provided;

a converter for converting sound pressure into an electrical signal, the converter being mounted on the top surface of the substrate;

a shield cap; and a bump, wherein the converter includes a main body having a back space, a diaphragm for receiving the sound pressure, the diaphragm being provided at the bottom of the back space of the main body, and a converter electrode provided on a region of a bottom surface of the main body facing the substrate electrode, the shield cap is in contact with top and side surfaces of the main body and covers the back space at a top of the back space, and the bump connects the substrate electrode and the converter electrode to each other.

2. The microphone of claim 1, wherein the main body of the converter is made of silicon.

3. The microphone of claim 2, wherein the diaphragm is made of silicon, and the main body and the diaphragm are continuous.

4. The microphone of claim 1, wherein the back space penetrates the main body and expands upward from the diaphragm.

5. The microphone of claim 1, further comprising a resin member covering a portion of the top surface of the substrate and at least a portion of an external surface of the shield cap.

6. The microphone of claim 5, wherein the resin member covers a side surface of the shield cap.

7. The microphone of claim 1, further comprising an amplifier for amplifying a signal generated by the converter.

8. The microphone of claim 1, wherein the substrate includes a mounting terminal provided on a bottom surface of the substrate.

9. The microphone of claim 1, wherein the back space has a volume larger than that of a space between a bottom surface of the diaphragm and the tone hole.

10. A method for fabricating a microphone, the method comprising the steps of:

(a) preparing a converter including a main body having a back space, a diaphragm provided at the bottom of the back space, and a converter electrode provided on a bottom surface of the main body;

(b) mounting the converter on a substrate including a tone hole and having a top surface on which a substrate electrode is provided at a position corresponding to the converter electrode, and connecting the converter electrode and the substrate electrode to each other; and (c) providing, on the substrate, a shield cap which is in contact with top and side surfaces of the main body and covers the back space at a top of the back space, after the step (b).

11. The method of claim 10, wherein in step (b), the converter electrode and the substrate electrode are connected to each other by thermosonic bonding.

12. The method of claim 10, further comprising the step of (d) encapsulating, with resin, a portion of the top surface of the substrate and at least a portion of an external surface of the shield cap, after step (c).

13. The method of claim 10, wherein step (a) includes the step of (a1) selectively performing wet etching on a center portion of a silicon plate, thereby forming the back space in the shape of an inverted pyramid.

14. The method of claim 13, wherein in step (a1), the wet etching is stopped before the back space penetrates the main body, thereby making the diaphragm and the main body continuous.

* * * * *